US005161598A

United States Patent [19]

Iwamoto et al.

[11] Patent Number: 5,161,598

[45] Date of Patent: Nov. 10, 1992

[54] METHOD OF CONTROLLING MOLD PRESSURE PIN FOR PRESS CASTING MACHINE

[75] Inventors: Norihiro Iwamoto, Sagamihara; Masayuki Takamura, Numazu; Masaru Kobayashi, Odawara, all of Japan

[73] Assignee: Toshiba Kikai Kabushiki Kaisha, Tokyo, Japan

[21] Appl. No.: 753,940

[22] Filed: Sep. 3, 1991

[30] Foreign Application Priority Data

Sep. 5, 1990 [JP] Japan ..... 2-235133

[51] Int. Cl.[5] ..... B22D 27/11

[52] U.S. Cl. ..... 164/120; 164/4.1

[58] Field of Search ..... 164/120, 4.1, 457

[56] References Cited

FOREIGN PATENT DOCUMENTS 64-83360 3/1989 Japan ..... 164/120

*Primary Examiner*—Kuang Y. Lin

*Attorney, Agent, or Firm*—Stevens, Davis, Miller & Mosher

[57] ABSTRACT

In a press casting machine a molten material enclosed in a cavity of a mold is squeezed by a pressure pin, the pressure pin is controlled by automatically controlling the start timing thereof. Namely, an optimum stroke of the pressure pin is preliminarily set and an actual stroke thereof is detected. The detected stroke of the pressure pin is compared with the optimum stroke thereof and a start timing of the pressure pin is corrected or modified so that the stroke thereof is made optimum. When the detected stroke of the pressure pin is smaller than the set stroke thereof, the start timing of the pressure pin is corrected so that a timing for starting the pressure pin advances and, on the contrary, when the detected stroke of the pressure pin is larger than the set stroke thereof, the start timing of the pressure pin is corrected so that a timing for starting the pressure pin is delayed.

8 Claims, 4 Drawing Sheets

METHOD OF CONTROLLING MOLD PRESSURE PIN FOR PRESS CASTING MACHINE

BACKGROUND OF THE INVENTION

The present invention relates to a press or pressure casting machine such as a die-cast machine and, more particularly, to a method of controlling a mold pressure pin for squeezing a molten material enclosed in a mold.

In general, in a pressure casting machine, when the molten material enclosed in the mold is solidified, its volume is contracted, causing a shrinkage porosity to be generated. As a result, the strength, the airtightness and the like are adversely effected. In particular, since a die-cast machine generates a steep temperature gradient, an excessively large shrinkage porosity is generated.

Hitherto, in order to prevent the generation of such shrinkage porosity, a pressure pin is used to squeeze a molten material enclosed in a mold so as to homogenize the structure.

As a method of controlling the pressure pin, a structure has been employed which is arranged in such a manner that an injection pressure detection sensor is used to detect the injection pressure. When the detected pressure has been raised to a predetermined pressure level, a solenoid valve for controlling the operation of the pressure pin is excited through a control panel so as to operate a pressure pin cylinder.

In the die-cast machine thus-constituted, the pressure pin must specially have a function of effectively squeezing the molten material by making the squeezing timing to be the most suitable timing because the molten material solidifies at a considerably high speed. That is, if the squeezing timing is too fast or too late, a satisfactory squeezing effect cannot be obtained. Furthermore, since the solidifying time is too short, the allowable range for the above-described timing will become extremely short.

According to the conventional technology, the timing at which the pressure pin is started has been determined only by using a signal transmitted from the injection pressure detection sensor of the die-cast machine. Therefore, it has been difficult to obtain the effective timing. Furthermore, the introduced depth of the pressure pin into the squeezed portion of the cast product has been measured for the comparison of the obtained result of the measurement with the stroke of the pressure pin so that the determination of the timing at which the pressure pin is started is changed.

However, since the relationship between the stroke of the pressure pin and the predetermined value of the timing at which the pressure pin is started is too complicated, the determination can be made only by trial and error and thereby an excessively long time has been required. In particular, since the predetermined timing must be varied to correspond to each mold and casting condition, an excessively tedious task must be performed.

Even if a value of the above-described timing is determined, the state of solidification of the molten material will be changed due to change in the temperature of the mold or the like. Furthermore, since the die-cast machine is also affected by the temperature of the hydraulic oil or the like, the relationship between the stroke of the pressure pin and the predetermined start timing can be deflected from the initial state. As a result, a problem arises in that the depth of the introduced pressure pin can be deviated from the allowable range. In order to administrate it, a great effort has been required.

It might be considered feasible to employ another method of determining the timing which is arranged in such a manner that a signal denoting the injection start or a position signal at the time of the high speed injection start is used to start a timer with which the solenoid valve for controlling the pressure pin in excited. However, similarly to such case where the injection pressure is used as the reference, it has been difficult to determine the timing at which the pressure pin is started and to stably maintain the timing.

In both the case in which the injection pressure is used as the reference and the case in which the injection start or the high speed injection start is used as the reference, the control signals are communicated with each other on the sequence of the control panel for controlling the operation of the die-cast machine. Therefore, the scan time of each of the relays and the like, which constitute the sequence, are added and thereby a problem arises in that dispersion cannot be reduced.

SUMMARY OF THE INVENTION

An object of the present invention is to substantially eliminate defects or drawbacks encountered in the prior art and to provide a method of controlling a mold pressure pin for a pressure casting machine capable of quickly and easily determining the start timing of the pressure pin and stably maintaining the timing.

This and other object can be achieved according to the present invention by providing a method of controlling a pressure pin of a press casting machine in which a molten material enclosed in a cavity of a mold is squeezed by a pressure pin, characterized in that an optimum stroke of the pressure pin is preliminarily set and an actual stroke thereof is detected. The detected stroke of the pressure pin is compared with the optimum stroke thereof and a start timing of the pressure pin is corrected or modified so that the stroke thereof is made optimum. When the detected stroke of the pressure pin is smaller than the set stroke thereof, the start timing of the pressure pin is corrected so that a timing for starting the pressure pin advances and, on the contrary, when the detected stroke of the pressure pin is larger than the set stroke thereof, the start timing of the pressure pin is corrected so that a timing for starting the pressure pin is delayed.

According to the thus-constituted method of controlling the mold pressure pin for a pressure casting machine, the determination is made in accordance with the result of the detected stroke of the pressure pin. That is, the stroke of the pressure pin is determined so as to be subjected to a comparison with an actually detected stroke. Then, in accordance with the result of the comparison, the start timing period, in which the pressure pin start signal is transmitted, is fed back so as to automatically modify the predetermined start timing period.

In a case where the stroke of the pressure pin is smaller than the predetermined stroke for the pressure pin, a fact can be considered that the solidification has been completed before the pressure pin reaches the predetermined stroke. Therefore, the value of the start timing period of the pressure pin is again modified so as to advance the timing at which the pressure pin is started.

On the other hand, if the stroke of the pressure pin is larger than the predetermined stroke of the pressure pin, a fact can be considered that squeezing is performed before the solidification of the portion which is required to be squeezed is completed. Therefore, the value of the start timing period is again modified so that the timing at which the pressure pin is started is delayed.

Furthermore, by directly transmitting a signal from an exclusive controller for determining the start timing period to the portion for controlling the operation of the pressure pin, the influence of the non-uniform scan time of the sequencer can be minimized. As a result, the start timing can further be stabilized.

BRIEF DECRIPTION OF THE DRAWINGS

For a better understanding of the present invention and to show how the same is carried out, reference is made, by way of preferred embodiment, to the accompanying drawings, in which.

DESCRIPTION OF THE PREFERRED EMBODIMENT

Figure 1:
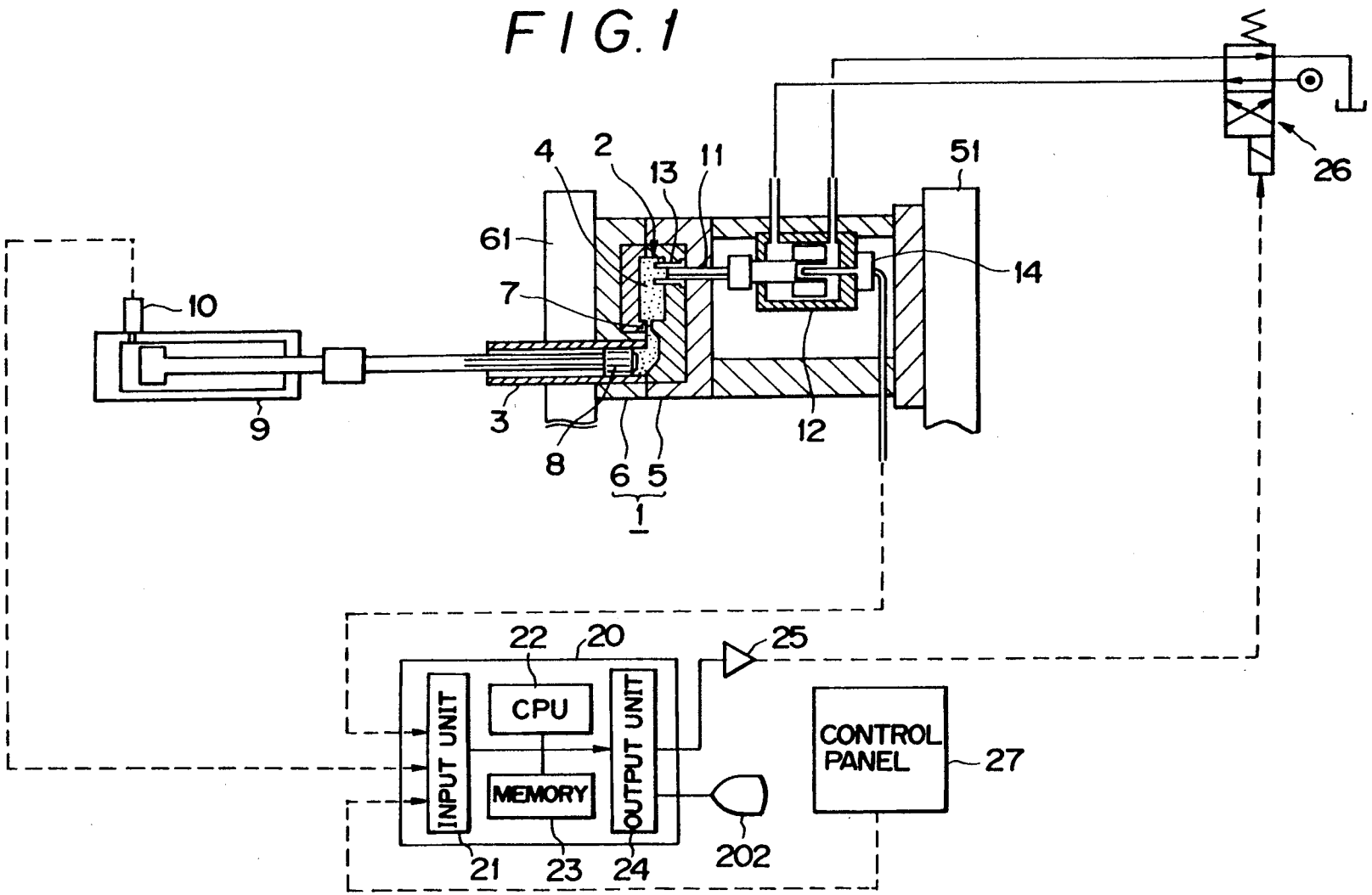
FIG. 1 is a block diagram illustrating a structure of a pressure casting machine to be controlled by the method according to the present invention.

A preferred embodiment of the present invention will now be described with reference to the drawings. FIG. 1 illustrates the essential structure of a die-cast machine to which a method of controlling a pressing pin according to the present invention is adapted. Referring to the drawing, reference numeral 1 represents a mold having a cavity 2 into which molten material 4 is injected from an injection sleeve 3.

The mold 1 is composed of a movable mold half 5 and a fixed mold half 6, the movable mold half 5 being fastened to a movable plate 51 of the die-cast machine. The fixed mold half 6 is fastened to a stationary plate 61. As a result, when the movable plate 51 is moved, the mold clamping and opening operations are performed.

The injection sleeve 3 is fastened to the stationary plate 61 in such a manner that its front opening portion is communicated with the inside portion of the cavity 2 of the mold 1 so that the enclosed molten material 4 is injected through an injection plunger 8 inserted into the injection sleeve 3. The operation of the injection plunger 8 is controlled by an injection cylinder 9 coaxially disposed with the injection sleeve 3. The injection cylinder 9 has an injection pressure detection sensor 10.

The mold 1 includes a pressure pin 11 and a pressure pin cylinder 12 for operating the pressure pin 11 at positions between the movable mold half 5 and the movable plate plate 51.

The pressure pin 11 is inserted into a pin insertion hole 13 formed in the movable mold 5, the pressure pin 11 having a front end portion which is able to project into the cavity 2. Furthermore, the pressure pin cylinder 12 and the pressure pin 11 are coaxially disposed.

Furthermore, there is provided a stroke detection sensor 14 for detecting the stroke of the pressure pin 11. The stroke detection sensor 14 is an absolute type displacement detector and comprises, according to this embodiment, a differential transformer. The absolute type stroke detection sensor 14 is arranged in such a manner that a constant value is always outputted at a certain stroke so that the sensor determines the position of the origin. According to this embodiment, the stroke detection sensor 14 is accomodated in the pressure pin cylinder 12.

Figure 2:
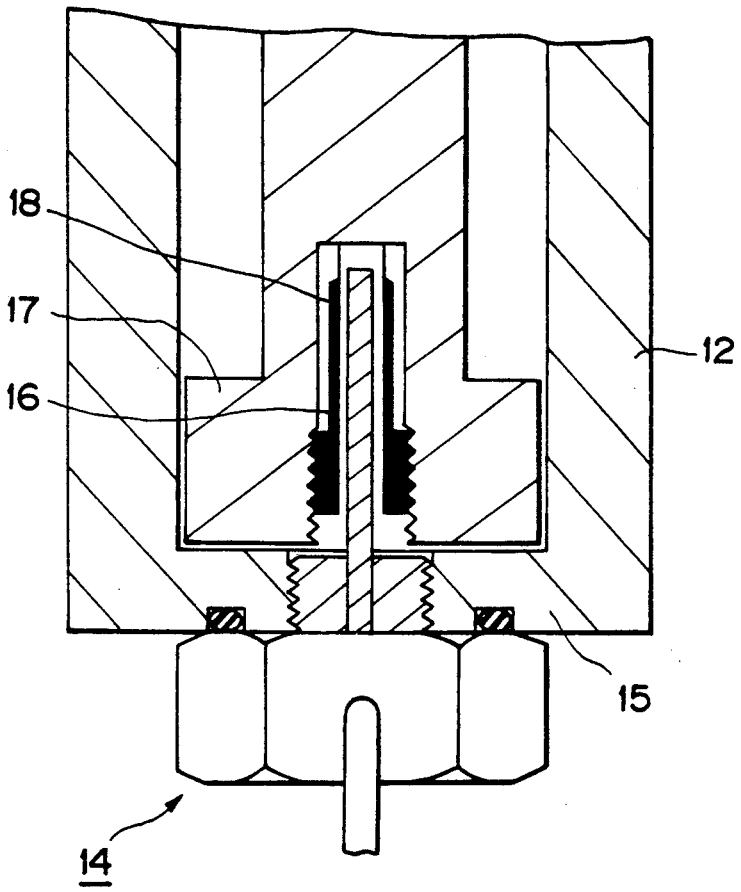
FIG. 2 is a vertical sectional view showing a stroke detection sensor shown in FIG. 1.

That is, as shown in FIG. 2, a coil portion 16 is secured to a cylinder head 15 of the pressure pin cylinder 12. Furthermore, a sleeve-shaped core 18 is included in the piston 17 to cover the coil portion 16. Therefore, when the piston 17 is moved, the included sleeve core 18 is moved together with it, causing the positional relationship between the coil portion 16 and the sleeve core 18 to be changed. As a result, voltage which corresponds to the position of the piston 17 is transmitted. Since the piston 17 and the pressure pin 11 are integrally connected to each other, the stroke of the pressure pin 11 can be detected by detecting the position of the piston 17.

As described above, by using the pressure pin cylinder 12 including the absolute type stroke detection sensor 14, an exclusive space required to place the stroke detection sensor 14 can be reduced. Furthermore, the limit in terms of the space and due to the pressure pin unit of the mold 1 can be minimized. That is, the interval between the movable mold half 5 and the movable plate 51 of the mold 1 into which the pressure pin cylinder 12 is disposed is usually so small that a limit is present in terms of the space. However, by arranging the structure in such a manner that the stroke detection sensor 14 is included in the pressure pin cylinder 12, the space can be satisfactorily saved.

The stroke detection sensor 14 is not limited to the above-described absolute type sensor and therefore an increment type sensor may be employed. However, the increment type sensor must use a signal denoting the position of the origin, causing problems in terms of the space saving and environmental limit to arise. Therefore, it is preferable that the absolute type sensor be employed.

The stroke detection sensor 14 and the injection pressure detection sensor 10 are connected to an input device 21 of a controller 20 serving as a control means so that each of input signals is received. The controller 20 comprises, in addition to the input device 21, a central processing unit (CPU) 22, a storage device (memory) 23 and an output device 24.

The output device 24 is, via an amplifier 25, connected to a solenoid valve 26 which controls the operation of the pressure pin cylinder 12.

Reference numeral 27 represents a control panel for controlling the various operations of the die-cast machine, the control panel 27 being connected to the controller 20 in order to input a variety of information items such as the initial value of most suitable stroke So for the pressure pin 11.

Figure 4A:
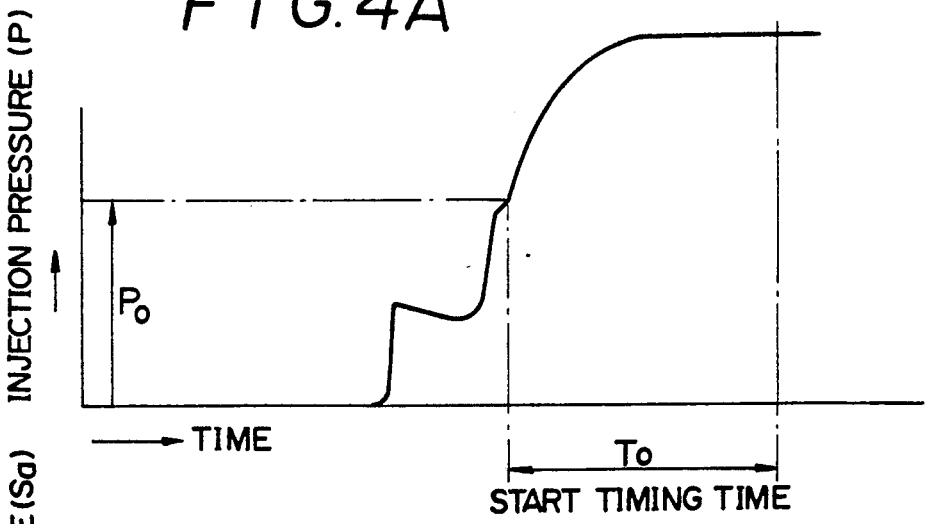
FIGS. 4A and 4B are graphs representing the change in the injection pressure of the pressure casting machine and the pressure pin stroke with time.
Figure 4B:
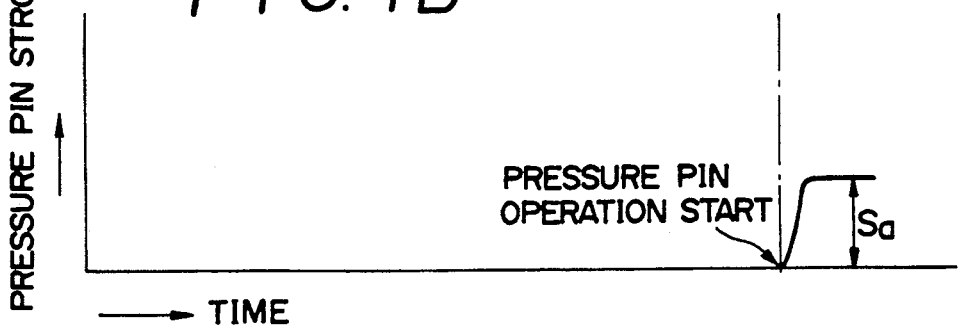

The pressure pin 11 is, as shown in FIGS. 4A and 4B, controlled in such a manner that a start timer 201 to be described later is operated at a moment at which injection pressure P is raised to a predetermined pressure Po, that is, at the moment when the pressure intensification is switched according to this graph. At the time of the time up after a predetermined start timing period To has passed, a start signal is transmitted to switch over the solenoid valve 26, causing the pressure pin cylinder 12 to be operated. As a result, the pressure pin 11 is started to perform squeezing.

Figure 3:
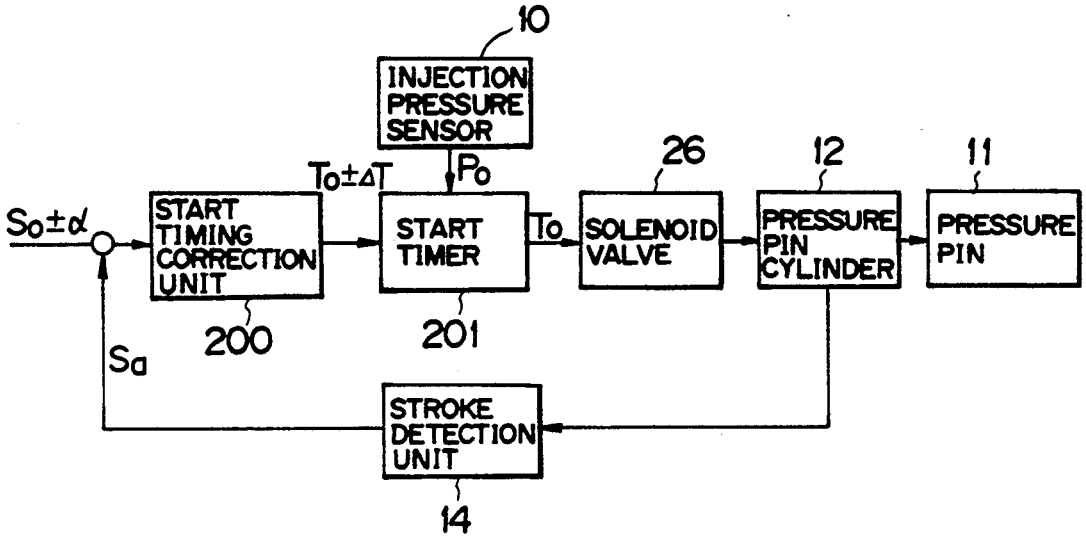
FIG. 3 is a block diagram of the operation performed by a controller.

FIG. 3 illustrates a block diagram about the control operation performed by the above-described controller 20.

That is, the stroke detection sensor 14 detects actual stroke Sa of the pressure pin 11, the detected stroke Sa being then fed back so as to be subjected to a comparison to be determined whether or not it is included in allowable range So+$\alpha$ of the most suitable stroke stored in the storage device 23. In accordance with the result of the comparison thus-made, small time unit $\Delta T$ stored in the storage device 23 is added and subtracted to and from determined value To of the start timing period by a start timing period modifying means 200 before the process proceeds to the next step.

Then, the modified start timing period is made to be the time up period for the start timer 201 so that, when the injection pressure P is raised to the predetermined injection pressure Po stored in the storage device 23, the start timer 201 is set, and then, a start timing is transmitted to the solenoid valve 26 after the modified start timing period To has passed. Furthermore, the pressure pin cylinder 12 is operated so as to detect the stroke of the pressure pin 11. The value thus-detected is fed back to sequentially repeat the injection processes. Thus, the injection stroke Sa of the pressure pin 11 is automatically controlled so as to be included in the allowable range So$\pm\alpha$ of the most suitable injection stroke So.

Then, the method of controlling the pressure pin will be described further in detail with reference to a flowchart shown in FIG. 5.

Figure 5:
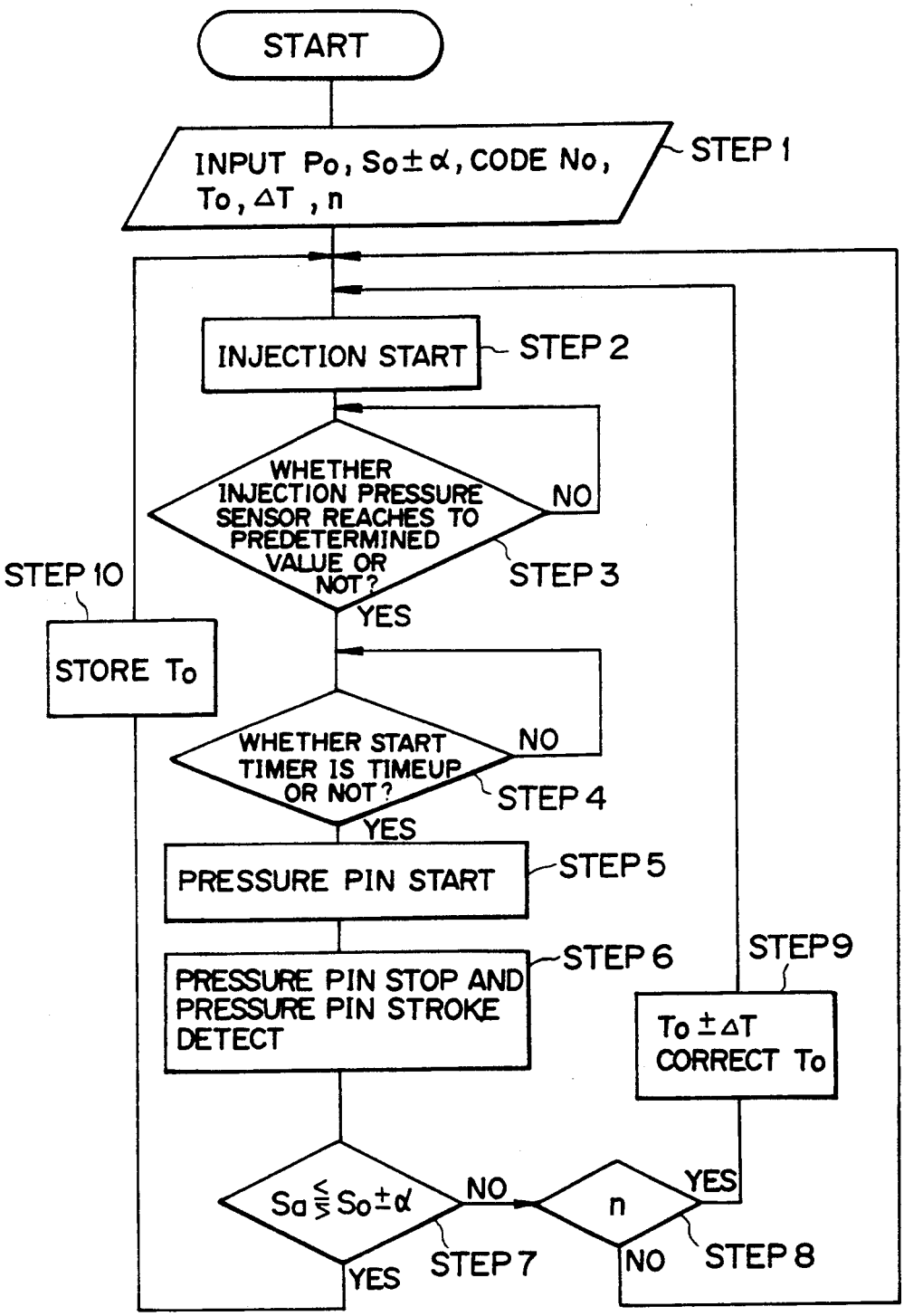
FIG. 5 is a flow chart which represents the flow of the control operation according to the method of the present invention.

Referring to FIG. 5, first, injection pressure Po, the most suitable stroke So, the allowable range$\pm\alpha$ of the most suitable stroke So, code number of the mold 1, the start timing period To which is the time up period of the start time 201, the small time unit $\Delta T$ serving as a modification unit of the start timing period To and the number of n of the shots serving as data to be modified are preset (Step 1). Then, the injection operation is started (Step 2).

When injection pressure P detected by the injection pressure sensor 10 is received through the input device 21 of the controller 20 and the injection pressure P reaches the predetermined pressure Po preset in the storage device 23, the start timer 201 is set (Steps 3 and 4).

Then, whether or not the time for the start timer 201 has been up is determined (Step 4). If the time has been up, the starting signal for starting the pressure pin 11 is transmitted to the solenoid valve 26 through the output device 24. As a result, the solenoid valve 26 is switched over and thereby the pressure pin cylinder 12 is operated. As a result, the pressure pin 11 is started to commence squeezing the molten material 4 in the mold 1 (Step 5).

The molten material 4 to be squeezed is in a state during the solidification and the further processing of the pressure pin 11 is inhibited and stopped in accordance with the degree of the solidification. The pressure pin stroke Sa at the moment of the above-described stoppage is detected by the stroke detection sensor 14 so as to be subjected, in the central processing unit 22, to a comparison with the most suitable stroke So stored in the storage device 23. As a result, a determination whether or not the detected stroke Sa is within the allowable range So $\pm\alpha$ of the most suitable stroke So is made (Step 7).

If the detected stroke Sa is within the allowable range, the start timing period To, which has been determined first, is stored in the storage device 23 (Step 10) before the next injection process is started.

If the detected stroke Sa is not within the allowable range, the start timing period To is modified to start the next injection process. The modification of the start timing is performed by adding or subtracting the predetermined small time unit $\Delta T$ from To (Step 9).

That is, in a case where the stroke Sa of the pressure pin 11 is smaller than allowable range So$-\alpha$ of the predetermined value So, a fact can be considered that the solidification has been completed before the pressure pin 11 reaches the predetermined stroke So. Therefore, $\Delta T$ is subtracted from the start timing period To so as to move the pressure pin 11 at an advanced timing.

On the other hand, if the stroke Sa of the pressure pin 11 is larger than allowable range So+$\alpha$ of the predetermined value, a fact can be considered that squeezing is performed before the solidification of the portion which is required to be squeezed is completed. Therefore, $\Delta T$ is added to To so as to make the start timing to be further delayed.

As described above, the predetermined stroke is determined to be the combination of a preset value So and a certain allowable range $\pm\alpha$ and the controller always performs feedback so as to make the detected actual stroke Sa of the pressure pin 11 to be within the above-described range. Furthermore, by providing a display means 202, the detected stroke Sa may be displayed in a digital manner or the like. As described above, if the structure is arranged in such a manner that the detected stroke is displayed, the evaluation in accordance with the result of the comparison with an actual product can easily be made.

The modification process is not limited to the above-described structure in which it is performed at each shot. It may be performed every several shots. According to this embodiment, the number n of shots serving as data is inputted and a discriminating process for discriminating the number of shots is provided (Step 8) between the stroke discriminating process in Step 7 and the start timing period modifying process in Step 9. For example, in a case where n is determined to 1, the start timing period To of the start timer 201 is modified at every shot. If n is determined to a plural number, for example, 3, the start timing period To is modified every three shots in accordance with data about two shots made previously.

A certain evaluation criterion is provided, the corresponding start timing period of the start timer 201 is previously stored in the storage device 23, and the value of the time for each mold, or if the same mold is used, the value for each casting condition is stored so that the above-described value is used as the initial value for the next casting operation.

Although the above-described embodiment is structured in such a manner that the start timing period of the pressure pin 11 is determined while using the pressure of the injection cylinder 9 as the reference, the other factors such as the hydraulic pressure, the injection speed, the injection stroke, the amount of the deflection of the mold or the extruding pin and the like may be used as the reference for determining the start timing.

The present invention is structured and operates as described above in such a manner that the stroke of the pressure pin is detected and the start timing of the pressure pin is controlled to make the detected value to be a predetermined stroke quantity. As a result, the start timing period of the pressure pin can be determined in a short time and the most suitable timing can always be obtained. Therefore, the most suitable squeezing effect can stably be maintained.

Furthermore, the above-described squeezing effect can be quickly reproduced under an arbitrary administration of each mold and each casting condition.

In addition, since the stroke of the pressure pin is detected by the stroke detection sensor, the evaluation in accordance with the result of the comparison made between an actual product and the detected value can easily be made. As a result, the squeezing effect can further be stabilized.

Furthermore, the drive control means such as the solenoid valve, which controls the operation of the pressure pin, is directly controlled by the exclusive controller. Therefore, the influence of the non-uniform scan time of the sequencer can be minimized.

It is to be understood that the present invention is not limited to the described preferred embodiment and many other changes and modifications may be made without departing from the scope of the apended claim.

What is claimed is:

1. A method of controlling a mold pressure pin of a press casting machine in which a molten material enclosed in a cavity of a mold is squeezed by the pressure pin, comprising the steps of:

setting preliminarily an optimum stroke of the pressure pin;

detecting a stroke of the pressure pin;

comparing the detected stroke of the pressure pin with the optimum stroke thereof; and correcting a start timing of the pressure pin so that the stroke thereof is made optimum.

2. A method according to claim 1, wherein the correction of the start timing of the pressure pin is automatically carried out.

3. A method according to claim 1, wherein when the detected stroke of the pressure pin is smaller than the set stroke thereof, the start timing of the pressure pin is corrected so that a timing for starting the pressure pin advances and when the detected stroke of the pressure pin is larger than the set stroke thereof, the start timing of the pressure pin is corrected so that a timing for starting the pressure pin is delayed.

4. A method according to claim 1, wherein the press casting machine includes a controller for controlling the start timing of the pressure pin and wherein the pressure pin is operated by a signal from the controller.

5. A method according to claim 4, wherein the set stroke has an allowable range and wherein the controller is always subjected to feedback so that the detected stroke of the pressure pin is always within the allowable range of the set stroke.

6. A method according to claim 1, wherein the correction step is performed every one shot of an injection molding.

7. A method according to claim 1, wherein the correction step is performed every several shots of the injection molding.

8. A method according to claim 1, wherein the start timing of the pressure pin is determined with reference to a pressure of an injection molding.

* * * * *